US011305147B1

(12) United States Patent
Womack

(10) Patent No.: US 11,305,147 B1
(45) Date of Patent: Apr. 19, 2022

(54) SUPPORT GARMENT FOR RESISTANCE EXERCISE

(71) Applicant: Michael Womack, Princeton, TX (US)

(72) Inventor: Michael Womack, Princeton, TX (US)

( * ) Notice: Subject to any disclaimer, the term of this patent is extended or adjusted under 35 U.S.C. 154(b) by 112 days.

(21) Appl. No.: 16/660,501

(22) Filed: Oct. 22, 2019

Related U.S. Application Data

(63) Continuation-in-part of application No. 16/565,402, filed on Sep. 9, 2019, which is a continuation-in-part of application No. 14/555,427, filed on Nov. 26, 2014, now Pat. No. 10,405,589.

(60) Provisional application No. 62/871,973, filed on Jul. 9, 2019, provisional application No. 62/753,564, filed on Oct. 31, 2018.

(51) Int. Cl.

| | |
|---|---|
| ***A63B 21/00*** | (2006.01) |
| ***A63B 21/055*** | (2006.01) |
| ***A63B 23/12*** | (2006.01) |
| ***A41D 13/00*** | (2006.01) |

(52) U.S. Cl.
CPC ..... *A63B 21/4025* (2015.10); *A41D 13/0015* (2013.01); *A63B 21/00043* (2013.01); *A63B 21/0557* (2013.01); *A63B 21/4017* (2015.10); *A63B 23/12* (2013.01)

(58) Field of Classification Search
CPC ..... A63B 21/4025; A63B 21/4017; A63B 21/0557; A63B 23/12; A41D 13/0015
See application file for complete search history.

(56) References Cited

U.S. PATENT DOCUMENTS 2,808,267 A * 10/1957 Heaton ..... A63B 69/0059 473/212
2,986,740 A * 6/1961 Schudson ..... A41D 27/10 2/115
3,116,735 A * 1/1964 Geimer ..... A61F 5/026 450/2
3,324,851 A * 6/1967 Posner ..... A61F 5/3723 128/878
3,548,818 A * 12/1970 Kaplan ..... A61F 13/146 602/19
3,724,846 A * 4/1973 Perrine ..... A63B 71/12 482/106
3,856,004 A * 12/1974 Cox ..... A61F 5/05808 602/19
4,273,328 A * 6/1981 Ozbey ..... A63B 21/00185 2/115
4,412,357 A * 11/1983 Mincher ..... A41D 13/0017 2/118

(Continued)

*Primary Examiner* — Richale L Quinn
(74) *Attorney, Agent, or Firm* — Michael Diaz

(57) ABSTRACT

A support garment for use during resistance training. The support garment includes a segment of elastomeric material having two ends and upper and lower perimeters. The segment of material also has a chest support segment located between the two ends. Each end is positioned and attached to the upper perimeter of the segment of material to form a sleeves band. Each sleeve band has an opening on opposite sides of the support garment. Each sleeve band is also configured to accommodate an arm of a user of the garment and are biased inwardly by the chest support segment. The user positions one arm in each sleeve band and positions the chest support segment across a chest of the user during resistance training.

11 Claims, 13 Drawing Sheets

(56) References Cited

U.S. PATENT DOCUMENTS 4,741,719 A * 5/1988 Wirth ..... A41D 31/185 450/30
4,890,841 A * 1/1990 Brooks ..... A63B 69/0059 473/212
4,993,705 A * 2/1991 Tolle ..... A63B 21/00185 482/124
5,308,305 A * 5/1994 Romney ..... A63B 21/4025 2/69
5,573,487 A * 11/1996 Wallner ..... A63B 21/0004 482/122
6,047,406 A * 4/2000 Dicker ..... A41D 13/0015 2/69
6,231,488 B1 * 5/2001 Dicker ..... A63B 21/0552 482/124
6,892,396 B2 * 5/2005 Uno ..... A41D 13/0015 2/115
7,908,670 B2 * 3/2011 Semba ..... A63B 21/4025 2/69
8,312,566 B2 * 11/2012 Weir ..... A63B 23/18 2/69
8,771,155 B1 * 7/2014 Bell ..... A63B 21/4017 482/124
9,009,863 B2 * 4/2015 Decker ..... A41D 31/185 2/44
D748,209 S * 1/2016 Alaniz, III ..... D21/662
9,655,389 B2 * 5/2017 Blakely ..... A41D 1/04
10,363,452 B2 * 7/2019 Alaniz, III ..... A41D 13/0015
10,405,589 B1 * 9/2019 Womack ..... A63B 21/4025
10,709,178 B2 * 7/2020 Alaniz, III ..... A41B 1/00
D908,969 S * 1/2021 Forell ..... D29/101.3
2003/0045408 A1 * 3/2003 Seles ..... A63B 23/03525 482/121
2008/0214330 A1 * 9/2008 Goebel ..... A63B 21/4021 473/438
2009/0062704 A1 * 3/2009 Brown ..... A41D 31/185 602/19
2010/0050313 A1 * 3/2010 Shackelford, Jr. ..... A41D 13/1245 2/69
2012/0295777 A1 * 11/2012 Zaki ..... A63B 23/035 482/122
2018/0256937 A1 * 9/2018 McCracken ..... A63B 21/4017

* cited by examiner

SUPPORT GARMENT FOR RESISTANCE EXERCISE

RELATED APPLICATIONS

This application is a continuation-in-part application of co-pending U.S. patent application Ser. No. 16/565,402 entitled "Bench Press Support Garment For Resistance Exercise" filed on Sep. 9, 2019 which is a continuation-in-part application of U.S. Pat. No. 10,405,589 entitled "Support Garment For Resistance Exercise" filed on Nov. 26, 2014 under the name of Michael Womack and also claims the benefit of U.S. Provisional Patent Application Ser. No. 62/871,973 filed Jul. 9, 2019 by Michael Womack, which are both hereby incorporated by reference. This application also claims the benefit of U.S. Provisional Patent Application Ser. No. 62/753,564 filed Oct. 31, 2018 by Michael Womack which is also hereby incorporated by reference.

BACKGROUND OF THE INVENTION

Field of the Invention

This invention relates to sports and rehabilitation equipment. Specifically, and not by way of limitation, the present invention relates to a garment for use in assisting during resistance training, such as weight training.

Description of the Related Art

Resistance training, such as weight training, weightlifting, or powerlifting is an excellent form of exercise, sport, and form of rehabilitation for injured patients. However, with the use of weights or other resistance devices, there is an inherent risk to damaging a person's shoulders during various resistance exercises. In one example, in the sports of weightlifting and powerlifting, a popular event is bench pressing where an individual attempt to bench press a maximum weight. Unfortunately, the geometry of the movement of the heavy weight places an extreme stress on the individual's shoulders. To assist in the reduction of this stress, many participants in this event utilize support garments providing a tight fit over the entire upper torso of the individual, thereby reducing some of the stress on the shoulders. These shirt garments are typically constructed of a heavy elastic material and fit very tightly around the individual. It is often very difficult to remove and put on these shirt garments. Additionally, although these existing garments assist in supporting the individual during the lift, even more support is needed to further reduce the stress to the individual to avoid injury during the bench press event.

Although there are no known prior art teachings of a garment such as that disclosed herein, a prior art reference that discusses subject matter that bears some relation to matters discussed herein is U.S. Pat. No. 8,771,155 to Bell (Bell). Bell discloses an exercise apparatus having two arm cuffs and a central rectangular-shaped piece of material connecting the two arm cuffs. The cuffs are sized and shaped to fit over the arms and cover the elbows of the user. Although the Bell apparatus does provide some support to the user during resistance exercise, Bell suffers from several disadvantages. The apparatus provides limited support to the user as support is merely providing at a region of the person's elbows and the areas adjacent to the elbows. Furthermore, the apparatus cannot be worn under a shirt and most be worn outside of any other clothing, thereby negating the use of the apparatus during a competition.

It would be advantageous to have a garment which provides greater support to an individual during various weight resistance exercises which may be worn by the user without restriction. It is an object of the present invention to provide such a garment.

SUMMARY OF THE INVENTION

In one aspect, the present invention is directed to a support garment for use during resistance training. The support garment includes a segment of elastomeric material having two ends and upper and lower perimeters. The segment of material also has a chest support segment located between the two ends. Each end is positioned and attached to the upper perimeter of the segment of material to form a sleeves band. Each sleeve band has an opening on opposite sides of the support garment. Each sleeve band is also configured to accommodate an arm of a user of the garment and are biased inwardly by the chest support segment. The user positions one arm in each sleeve band and positions the chest support segment across a chest of the user during resistance training.

DESCRIPTION OF THE INVENTION

Figure 1:
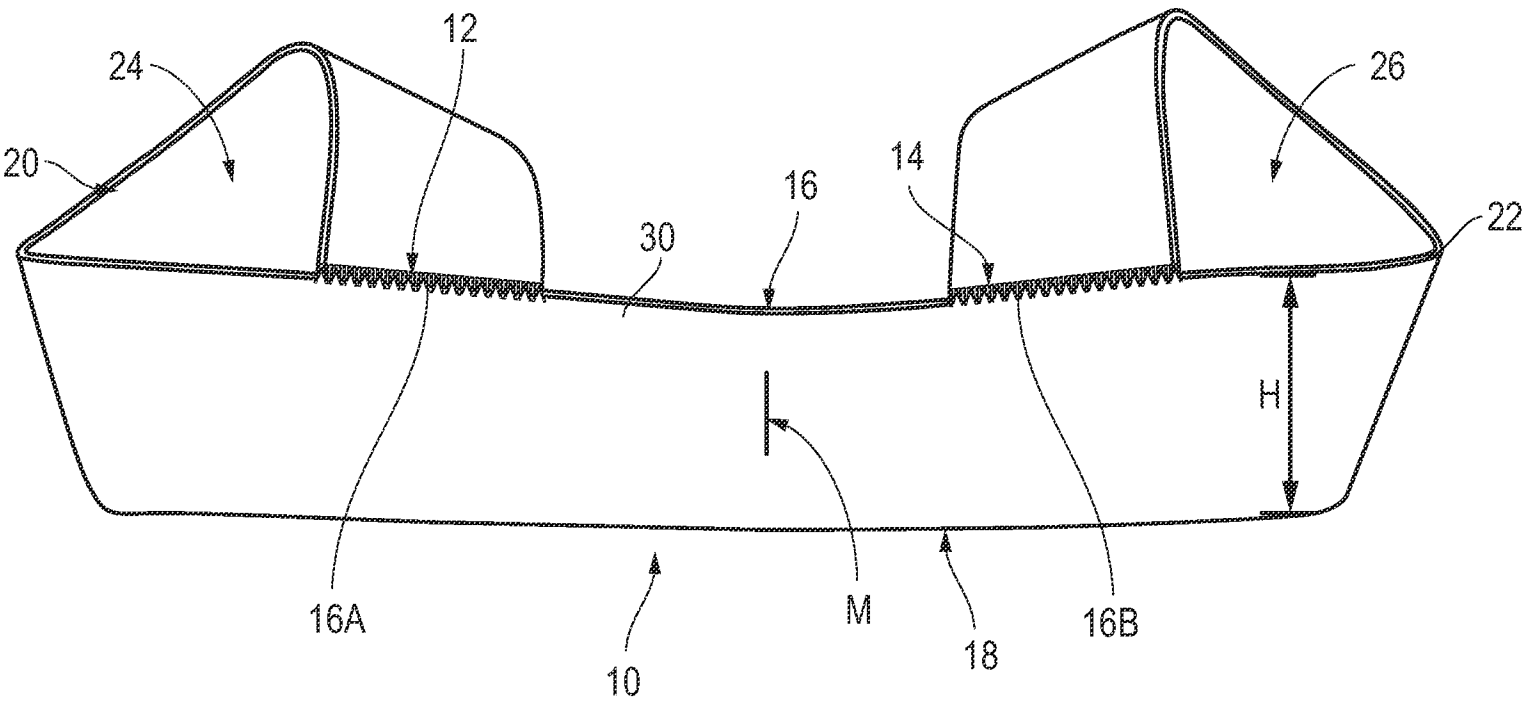
FIG. 1 is a front view of a central support strap in one embodiment of the present invention.
Figure 2:
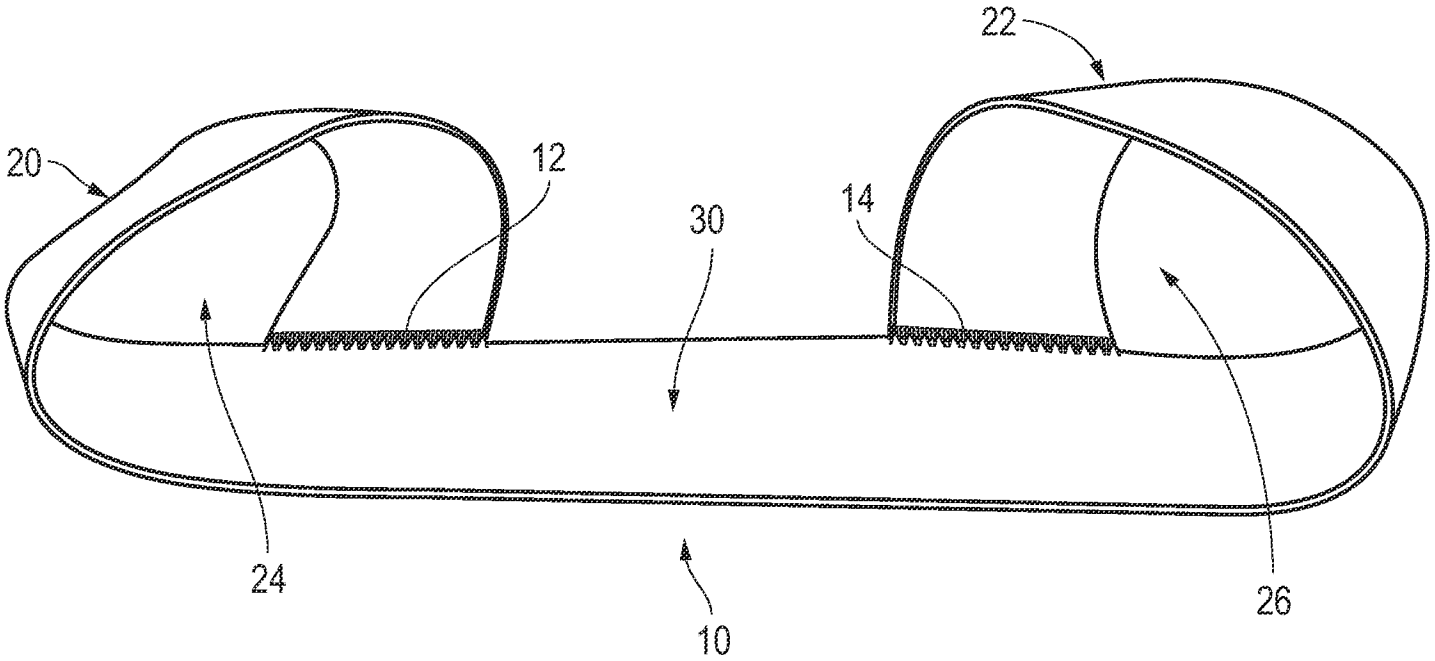
FIG. 2 is a rear view of the central support strap of FIG. 1.
Figure 3:
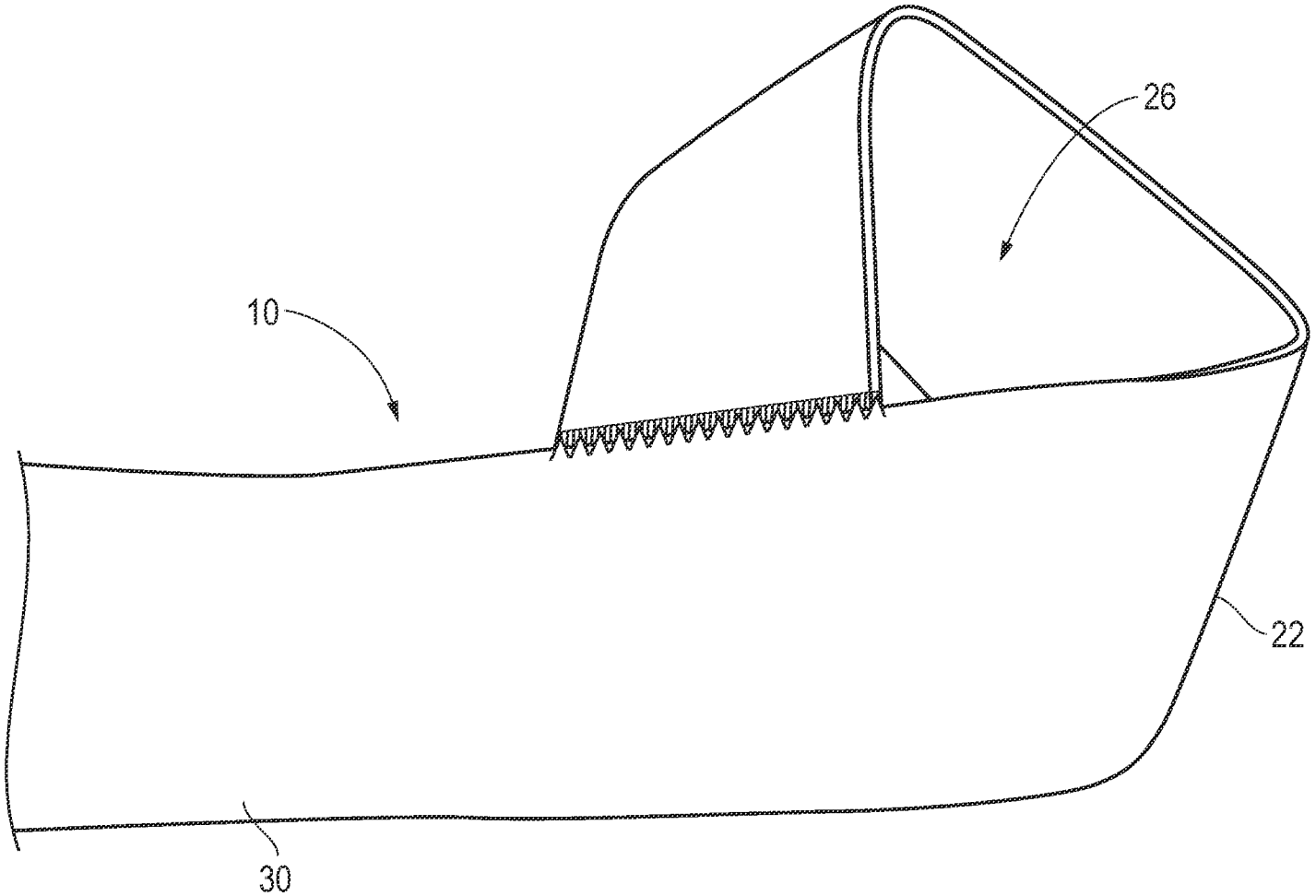
FIG. 3 is an enlarged front view of a portion of the central support strap.

The present invention is a garment providing support during weight resistance or powerlifting events. In the present invention, the support garment is a support strap. FIG. 1 is a front view of a central support strap 10 in one embodiment of the present invention. FIG. 2 is a rear view of the central support strap 10 of FIG. 1. FIG. 3 is an enlarged front view of a portion of the central support strap 10. The strap is a segment of material having a first end 12 and a second end 14 opposite the first end. The strap also has an upper perimeter 16 and an opposite lower perimeter 18. The strap has a dimensional height H. The first end 12 is positioned and attached on the upper perimeter 16 at point 16A while the second end is positioned and attached on the upper perimeter 16 at point 16B. Each end may be attached with any type of attachment device or means. As depicted in FIG. 1, the ends are stitched along the entire length of the ends to the upper perimeter 16. The ends 12 and 14 are positioned on the upper perimeter forming sleeve bands 20 and 22 with openings 24 and 26. The openings are configured to be sized and shaped to fit around the appropriate upper arm of a user with the openings configured to fit above each elbow of the user. Between the sleeve bands 20 and 22 is a chest support segment 30. The central support strap 10 may be constructed of a strong elastic material. In one embodiment, the elastic material is constructed from a material consisting of 70 percent elasticity and 30 percent cotton. However, the present invention may be constructed of an elastic material allowing support to the user of the support garment during resistance training. The chest support segment, preferably utilizing the strong elastic material, provides an inward bias toward a midpoint M of the central support strap 10.

Figure 4:
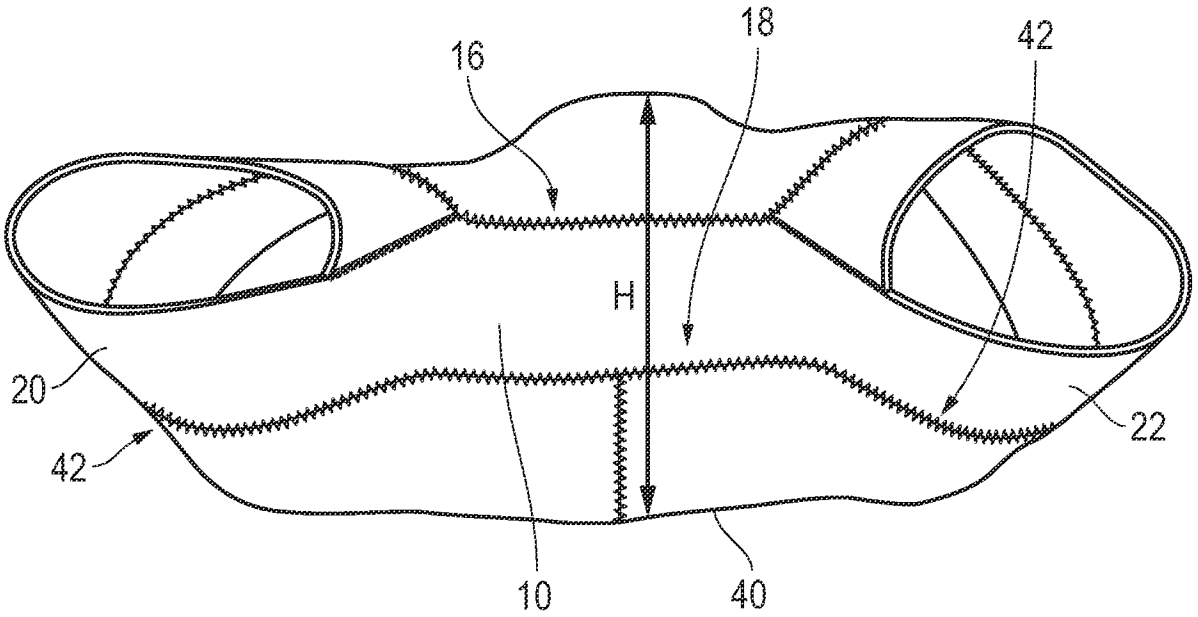
FIG. 4 is a front view of the central support strap having the supplemental band in a second embodiment of the present invention.
Figure 5:
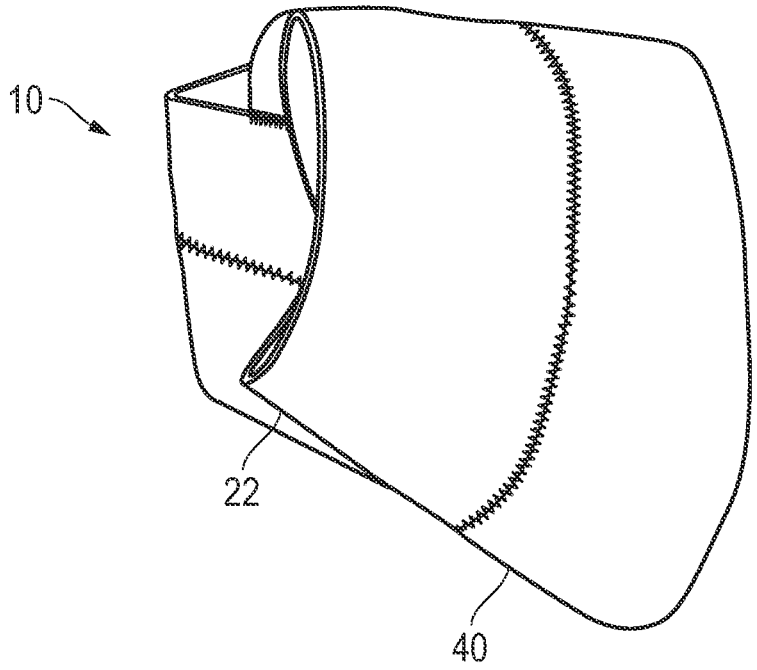
FIG. 5 is a side view of the central support strap of FIG. 4.
Figure 6:
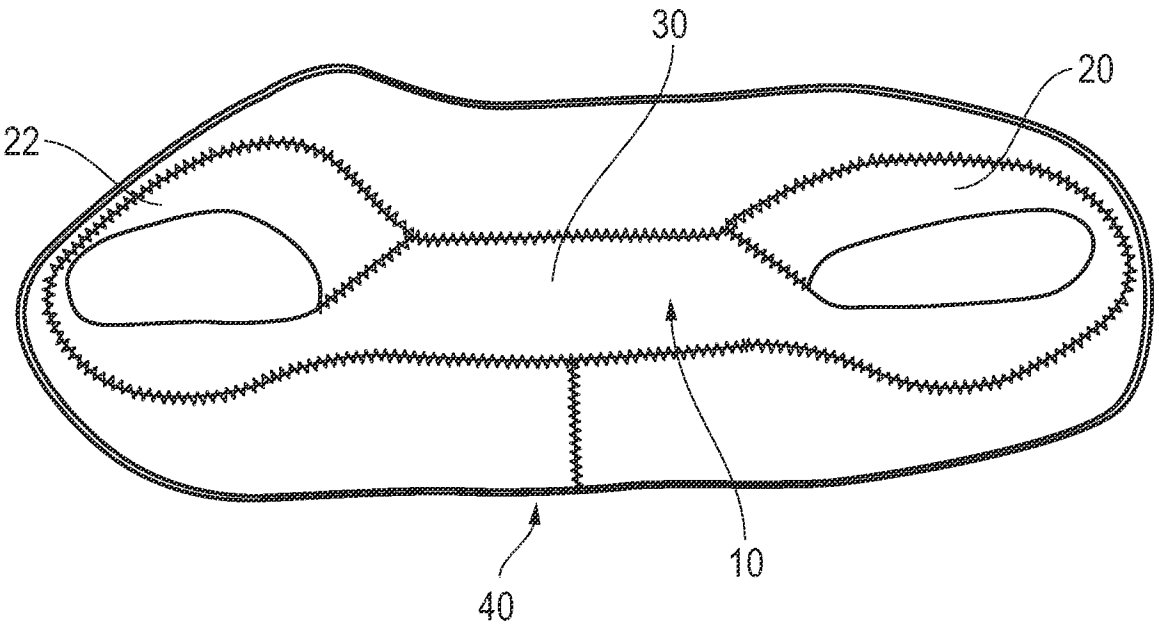
FIG. 6 is a rear view of the central support strap of FIG. 4.
Figure 7:
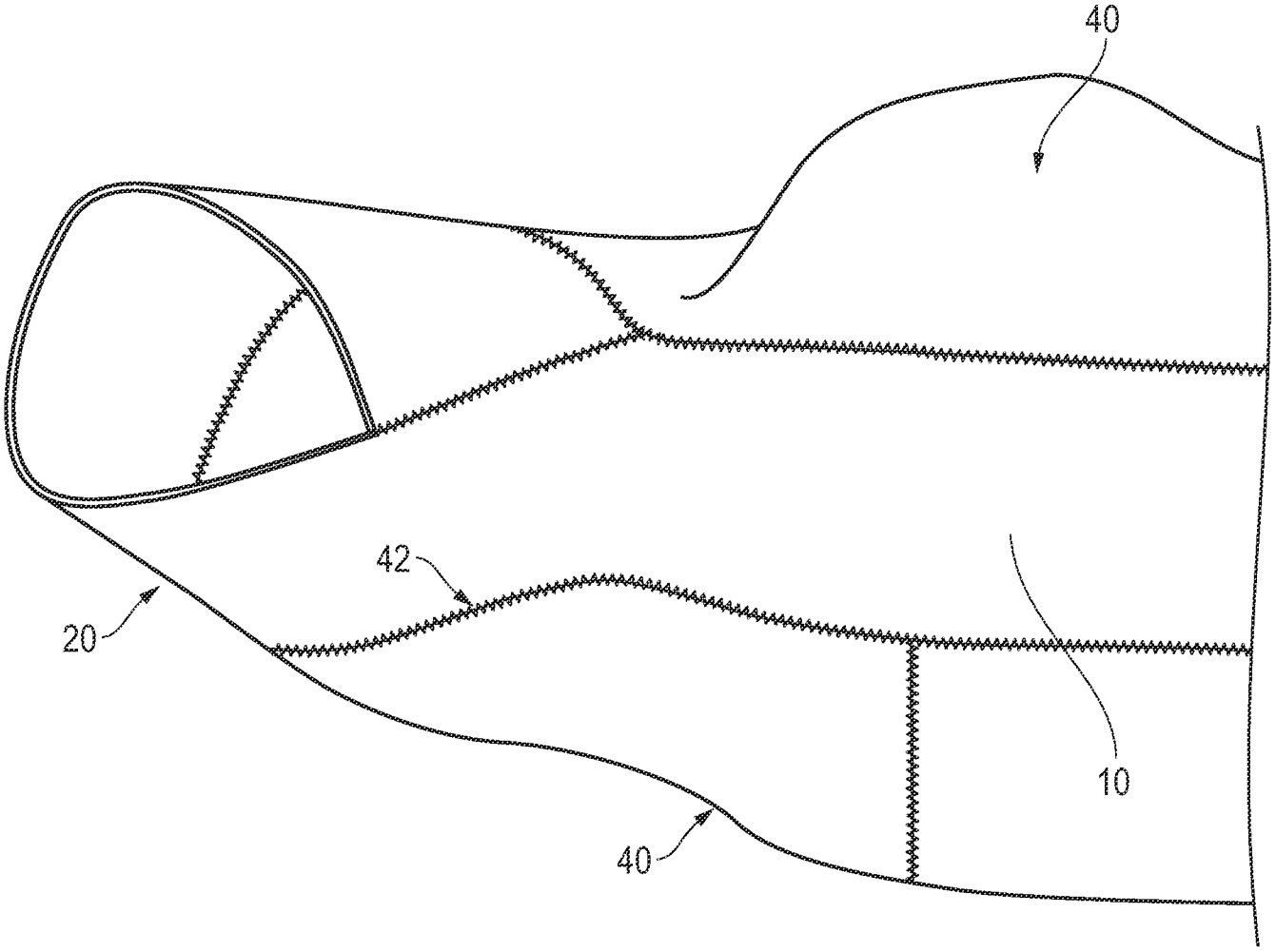
FIG. 7 is a front view of a portion of the central support strap of FIG. 4.

In another embodiment of the present invention, the central support strap 10 may utilize a supplemental bend 40. FIG. 4 is a front view of the central support strap 10 having the supplemental band 40 in a second embodiment of the present invention. FIG. 5 is a side view of the central support strap 10 of FIG. 4. FIG. 6 is a rear view of the central support strap 10 of FIG. 4. FIG. 7 is a front view of a portion of the central support strap of FIG. 4. In this embodiment depicted in FIG. 4, the supplemental band 40 provides both greater surface area surrounding the arms of the user and increased support for the user when utilizing the central support strap. Additionally, with the additional H of the supplemental band 40, the total H of the central support strap 10 is increased. The supplemental band is sized and shaped to attach to the border areas of the central support strap 10 (i.e., the upper perimeter 16, lower perimeter 18, and inner borders 42 of the sleeve bands 20 and 22. The supplemental band is configured to surround the upper arms of the user when worn.

Figure 8:
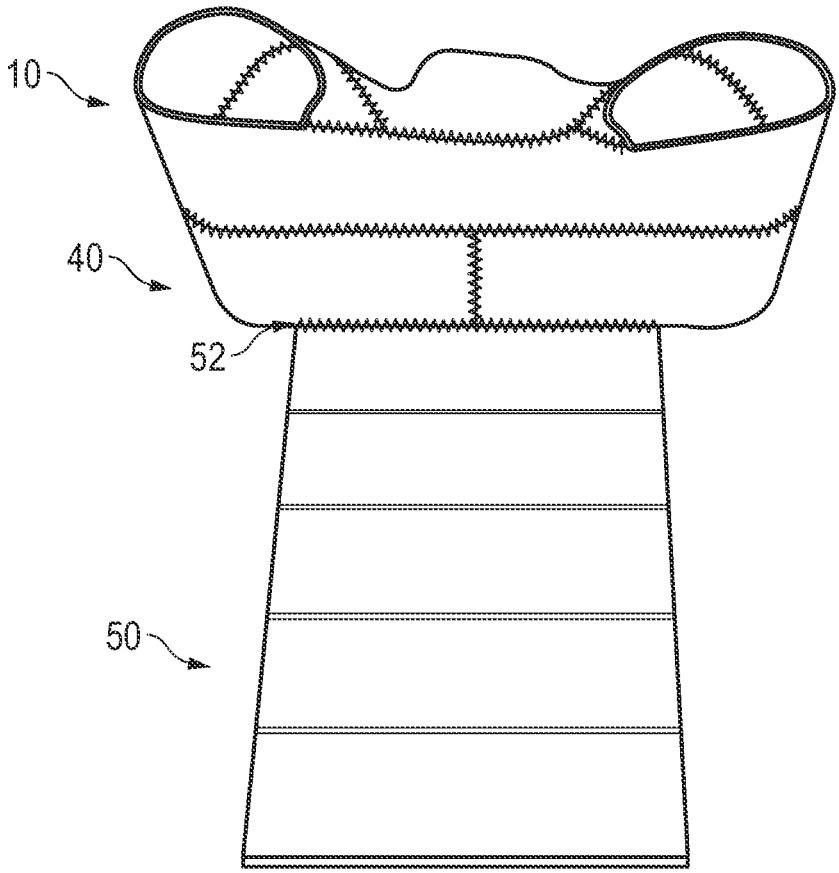
FIG. 8 is a front view of the central support strap having the supplemental band with a front bib in another embodiment of the present invention.
Figure 9:
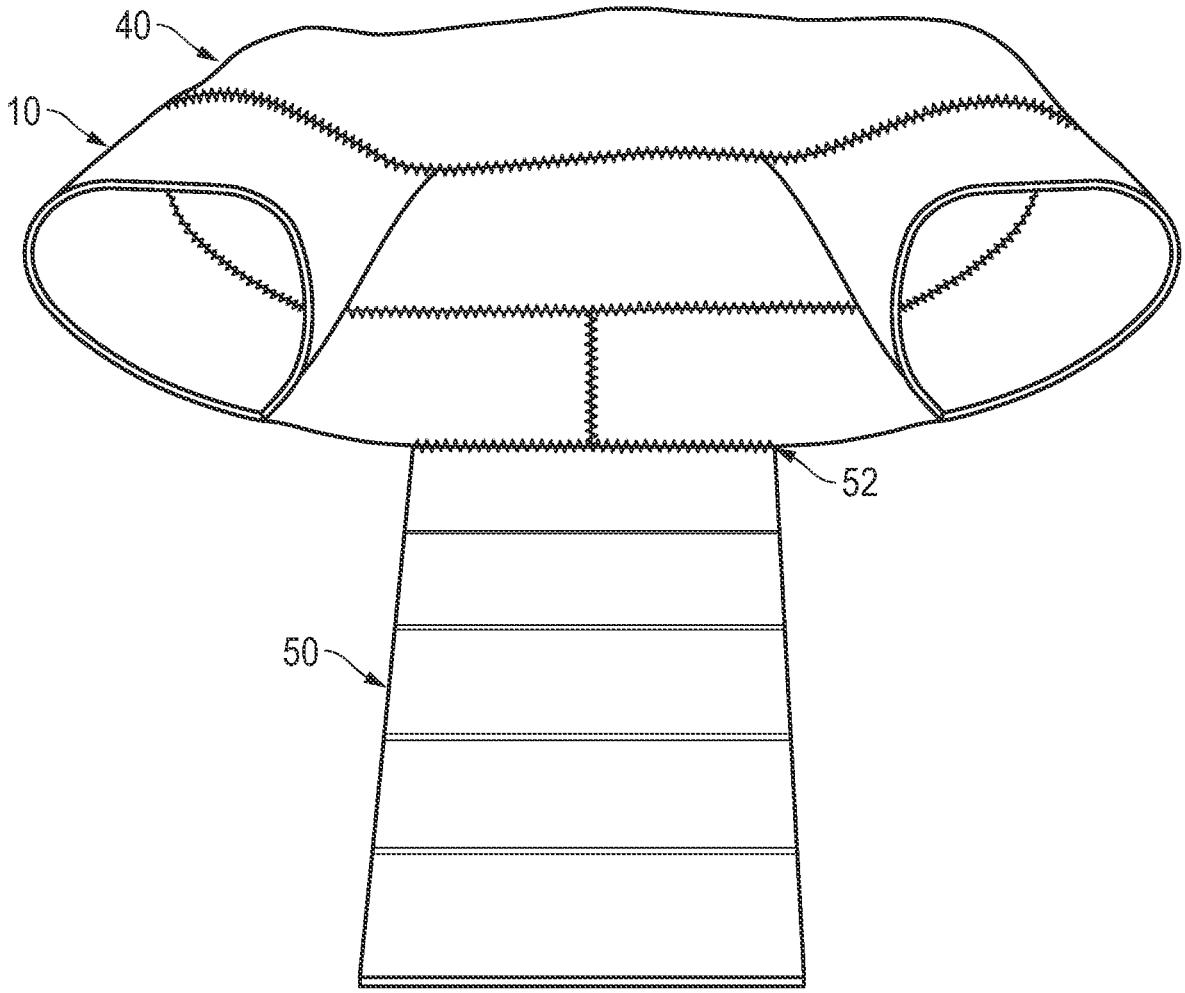
FIG. 9 is another front view of the central support strap of FIG. 8.

FIG. 8 is a front view of the central support strap 10 having the supplemental band 40 with a front bib 50 in another embodiment of the present invention. FIG. 9 is another front view of the central support strap 10 of FIG. 8. In this embodiment, a front bib 50 may be added to the central support strap 10 to cover the front torso of the user. The front bib is attached to a bottom portion 52 of the supplemental strap 40. The front bib 50 may be attached to any configuration of the central support strap 10 having any number of supplemental bands 40 or without the supplemental bands. By attaching the front bib 50 as well as a back area (not shown in FIG. 8), the central support strap 10 is incorporated in a shirt configuration. The front bid may be constructed of any material, such as an elastic material.

Figure 10:
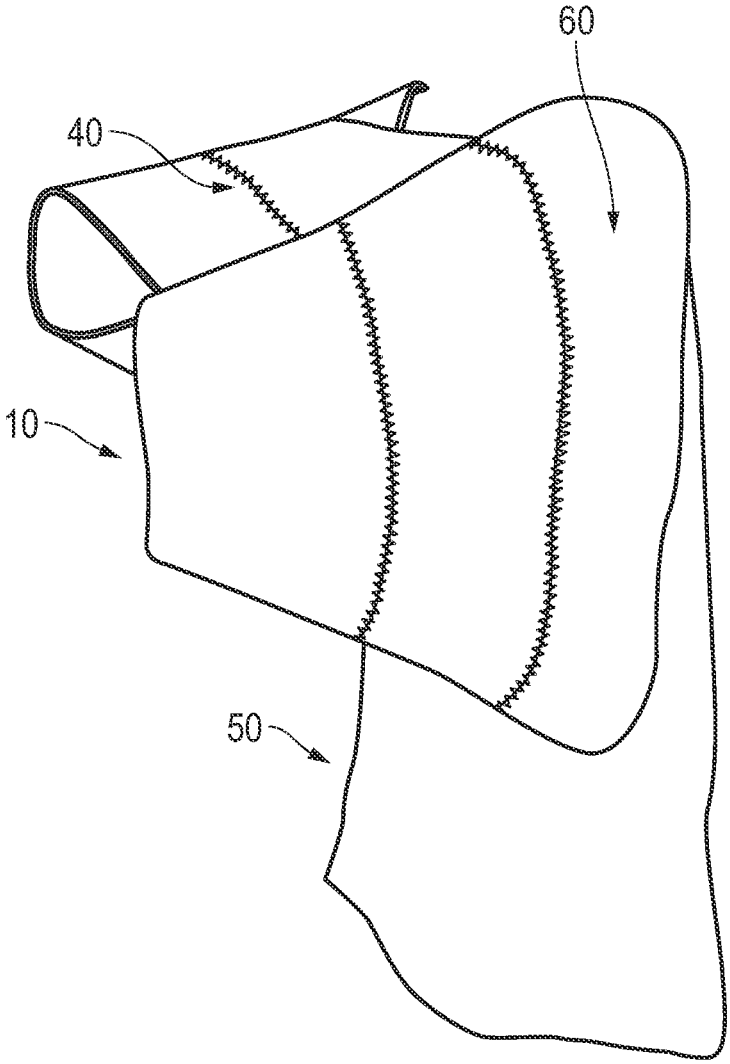
FIG. 10 is a side view of the central support strap having two supplemental bands in another embodiment of the present invention.

FIG. 10 is a side view of the central support strap 10 having two supplemental bands in another embodiment of the present invention. As depicted in FIG. 10, a secondary supplemental band 60 is attached to the first supplemental band 40. By adding an additional supplement band, the central support strap has increased surface area with additional support to the user. Any number of supplemental bands may or may not be utilized and still remain in the scope of the present invention.

Figure 11:
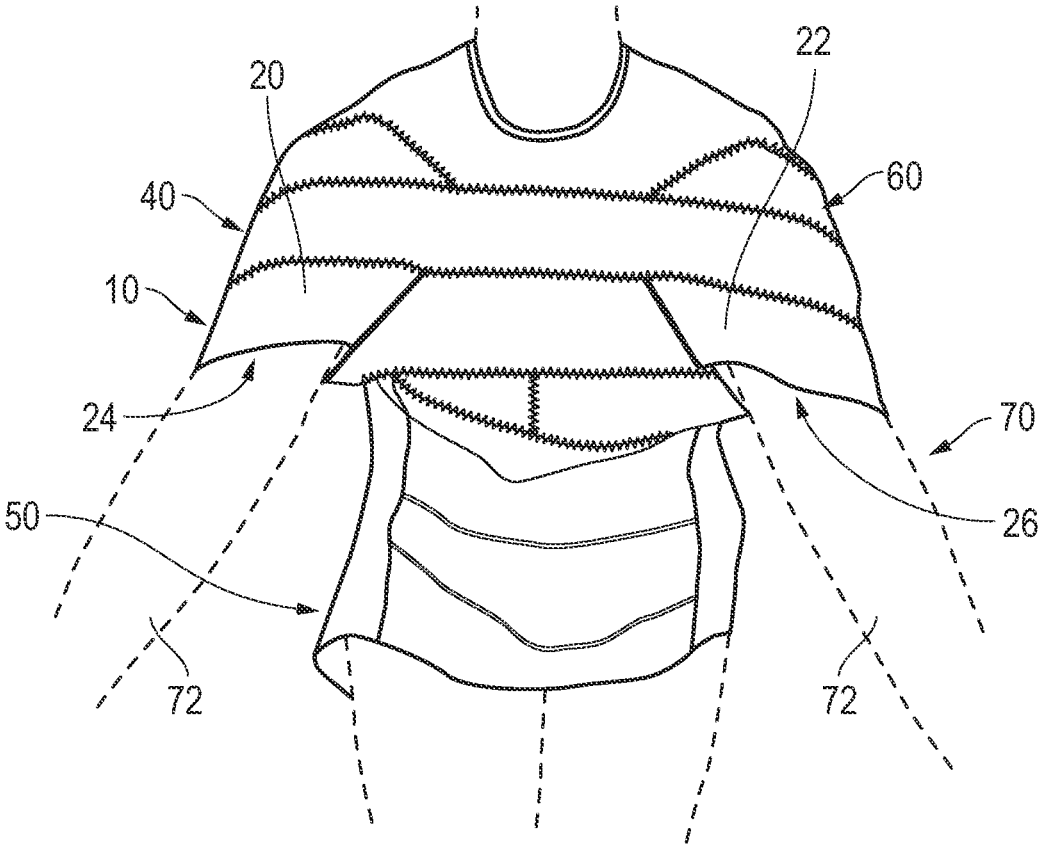
FIG. 11 illustrates the central support strap of FIG. 10 being worn by a user.
Figure 12:
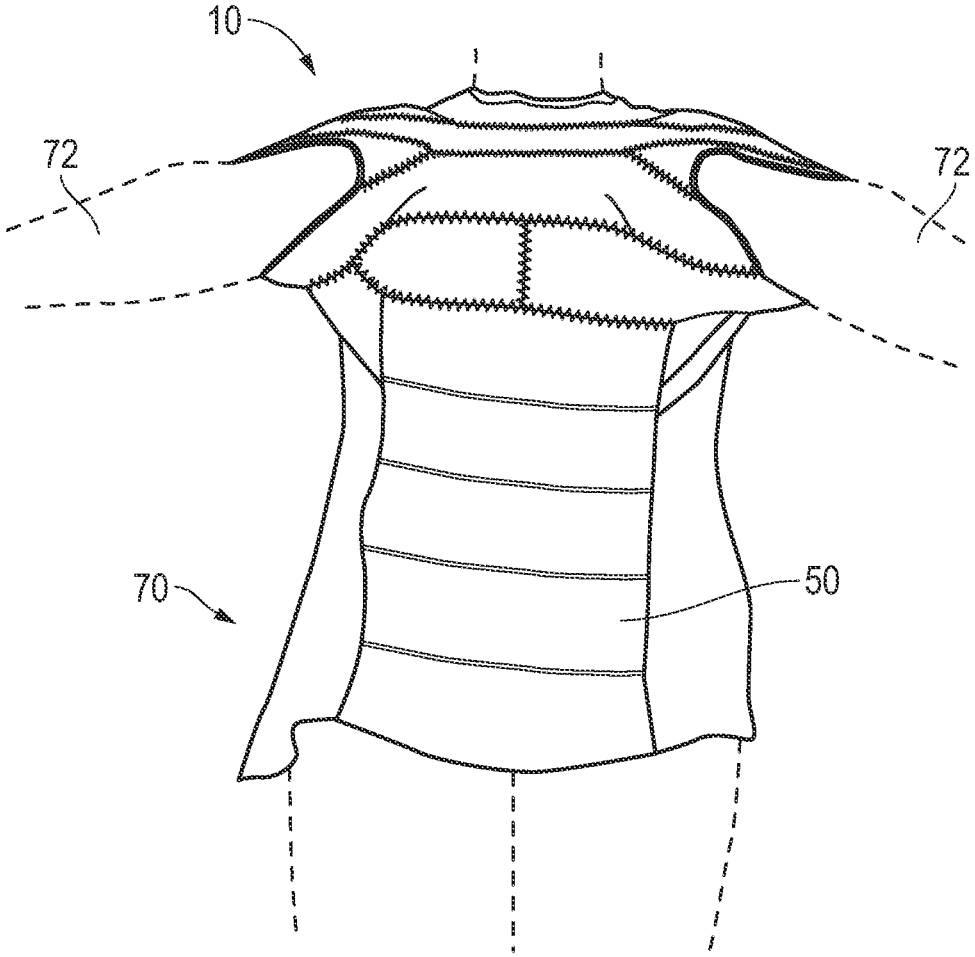
FIG. 12 illustrates a front view of the user wearing the central support strap of FIG. 10 with the user's arms extended.
Figure 13:
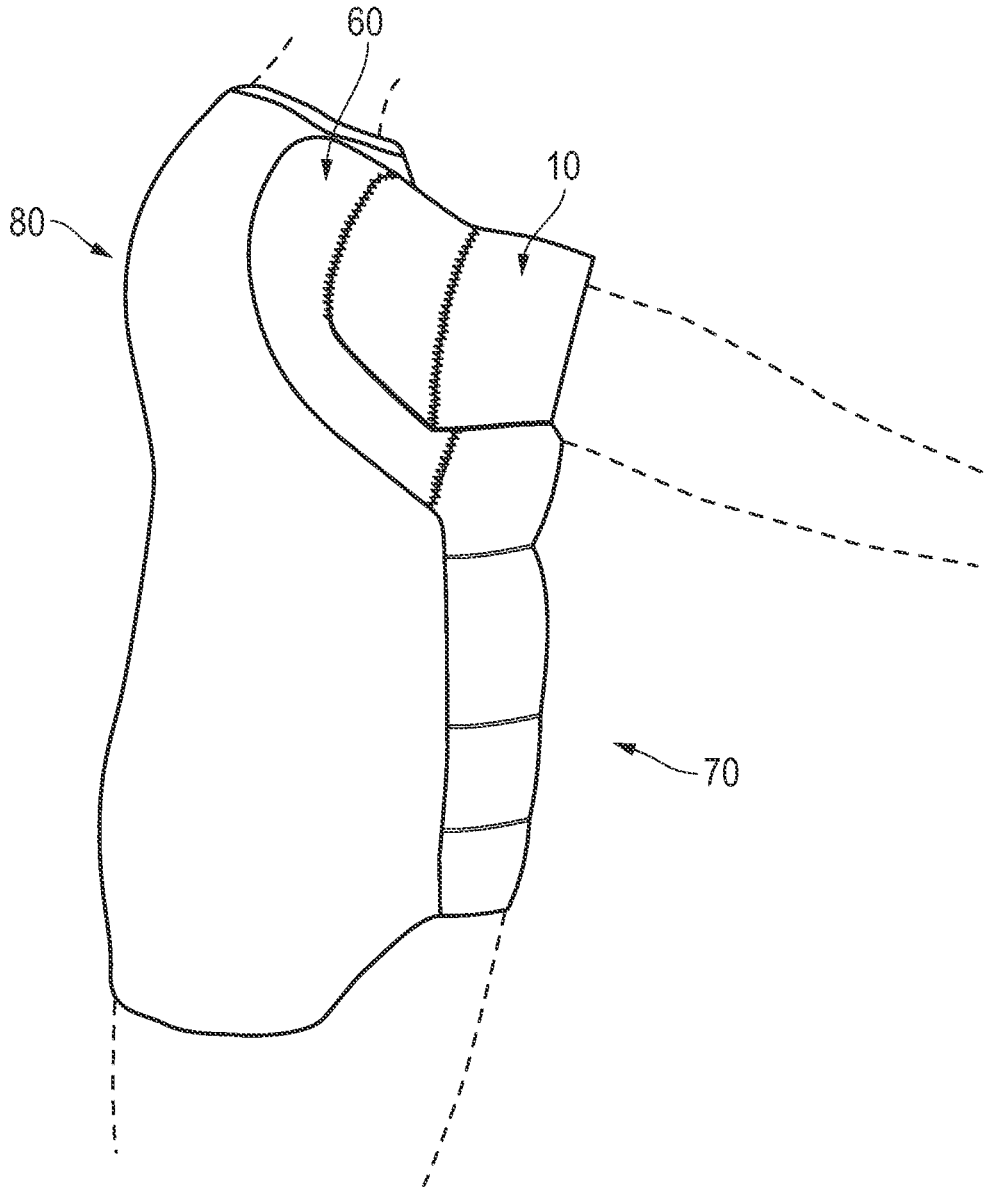
FIG. 13 is a side view of the central support strap of FIG. 10 with the user's arms extended.

FIG. 11 illustrates the central support strap 10 of FIG. 10 being worn by a user 70. The user 70 positions the user's arms 72 through the openings 24 and 28 and with the sleeve bands 20 and 22 surrounding the user's arms 72. The sleeve band are sized to fit above the elbows of the user. FIG. 12 illustrates a front view of the user 70 wearing the central support strap 10 of FIG. 10 with the user's arms 72 extended. With the user's arms extended upward while holding a weight bar, the support garment is biased in a contracted inward position, which results in providing support to the user in an extended position of the arms. FIG. 13 is a side view of the central support strap 10 of FIG. 10 with the user's arms extended. When the user's arms 72 are contracted while lowering a weight (not shown), the user has his arms contracted to allow the weight bar to be lowered against the chest of the user. Since the central support strap provides an inward bias through the chest support segment 30, as the user lowers the bar, the central support strap provides a force or support of the weight bar. The chest support segment 30 of the central support strap 10 lies flat against the user's chest. As the user again raises the bar, the bias assists the user in raising the bar. FIG. 13 also depicts a back portion 80 attached to the front bib 50 and the back of the central support strap 10. As shown in FIG. 13, the back portion is attached to the secondary support band 60 and covers a rear side of the torso of the user. The back portion may be constructed of any material, such as an elastic or cotton material. By using the back portion 80 and the front bib 50, the central support strap is configured as a shirt.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A support garment for use during resistance training, the support garment comprising:

a single segment of elastomeric material having a first end and an opposite second end with an upper perimeter and an opposite lower perimeter, the segment having a chest support segment located between the first end and the second end;

wherein the chest support segment is sized and shaped to fit over a front portion of a chest of a user;

wherein the first end is positioned and attached to the upper perimeter to form a first sleeve band having a first opening on a first side of the support garment;

wherein the second end is positioned and attached to the upper perimeter to form a second sleeve band having a second opening on a second end of the support garment opposite the first end;

wherein each sleeve band is configured to accommodate and support an upper arm of the user of the garment;

wherein the first and second sleeve bands are configured to bias inwardly toward a midpoint of the chest support segment and forward of the front portion of the chest of the user;

wherein the chest support segment and each sleeve band is composed of the same single segment of elastomeric material;

wherein the user positions one arm in each sleeve band and positions the chest support segment across a chest of the user during resistance training.

2. The support garment according to claim 1 wherein each sleeve band is configured for wear on an upper arm of the user above an elbow of the user.

3. The support garment according to claim 1 further comprising a bib extending from a lower portion of the support garment.

4. The support garment according to claim 3 wherein the bib section is constructed of an elastic material.

5. The support garment according to claim 3 wherein the bib section is configured to cover a region of a front torso of the user.

6. The support garment according to claim 3 further comprising a rear portion attached to the bib section and support garment.

7. The support garment according to claim 6 wherein the rear portion is a fabric configured for covering a back of the user.

8. The support garment according to claim 6 wherein the rear portion is constructed of a cotton material.

9. The support garment according to claim 1 further comprising a first supplemental band attached to the support garment, the supplemental band sized and shaped to encompass each arm of the user;

wherein the supplemental band is attached to an upper border area and lower border area of the chest support segment.

10. The support garment according to claim 9 wherein a second supplemental band is attached to the first supplemental band.

11. The support garment according to claim 1 further comprising a plurality of supplemental bands attached to the support garment, the plurality of supplemental bands sized and shaped to encompass each arm of the user.

* * * * *